United States Patent [19]

Nakagawa et al.

[11] 4,118,529

[45] Oct. 3, 1978

[54] SUEDE WOVEN FABRIC AND A PROCESS OF MANUFACTURING THE SAME

[75] Inventors: Junyo Nakagawa; Takao Akagi; Koji Hiramatsu, all of Kurashiki, Japan

[73] Assignee: Kuraray Company, Limited, Japan

[21] Appl. No.: 803,265

[22] Filed: Jun. 3, 1977

Related U.S. Application Data

[63] Continuation-in-part of Ser. No. 705,265, Jul. 14, 1976, abandoned.

[30] Foreign Application Priority Data

Jul. 14, 1975 [JP] Japan ..... 50-85984
Apr. 2, 1976 [JP] Japan ..... 51-37586

[51] Int. Cl.[2] ..... D02G 3/00

[52] U.S. Cl. ..... 428/91; 26/29 R; 428/92; 428/257; 428/258; 428/259; 428/399; 28/162; 28/218

[58] Field of Search ..... 428/85, 91, 92, 257, 428/258, 259, 399; 26/29 R; 28/72 P, 72.16

[56] References Cited

U.S. PATENT DOCUMENTS 3,988,488 10/1976 Civardi ..... 428/91

FOREIGN PATENT DOCUMENTS 1,300,268 12/1972 United Kingdom.

*Primary Examiner*—Marion E. McCamish
*Attorney, Agent, or Firm*—Oblon, Fisher, Spivak, McClelland & Maier

[57] ABSTRACT

A suede woven fabric comprises a warp yarn selected from the group consisting of polyester textured yarn, polyester filament yarn and polyester spun yarn, and a weft yarn of polyester island filaments whose mean thicknesses in denier are within the range from 0.05 to 0.50 and whose degree of variation of thickness is 15 to 60%; wherein a portion of said island filaments on at least one surface of the fabric is raised to form piles of individual island monofilaments whose mean lengths are from 0.5 to 4.0mm; wherein the number of floating points on said weft yarn, whose number of floats in within the range of 3 to 11, is 100 to 500/cm$^2$ of woven fabric, and wherein the relation between the shear stiffness $G_{0.5}$ at a shear angle of 0.5° and the stiffness $G_5$ at a shear angle of 5°, represented by $G_5/G_{0.5}$, is 1.5 to 15.

18 Claims, 18 Drawing Figures

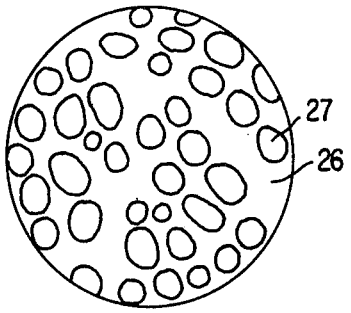
FIG. 10
| | | | | |
|---|---|---|---|---|
| Q | Q | Q | P | Q |
| Q | P | Q | Q | Q |
| Q | Q | Q | Q | P |
| Q | Q | P | Q | Q |
| P | Q | Q | Q | Q |
FIG. 11
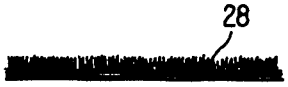
FIG. 12
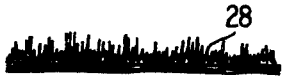
FIG. 13
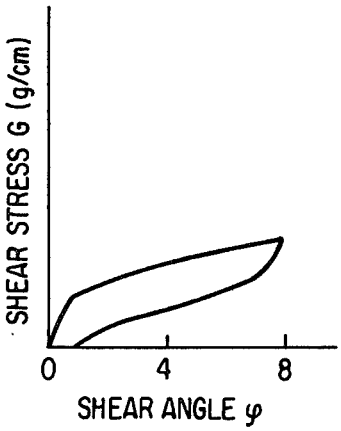
FIG. 14
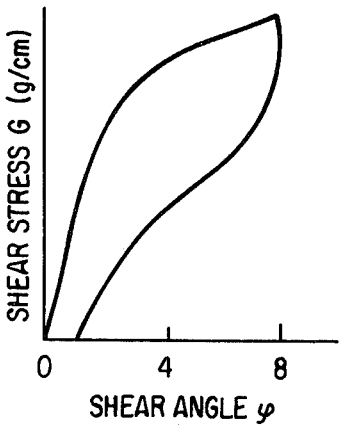
FIG. 15

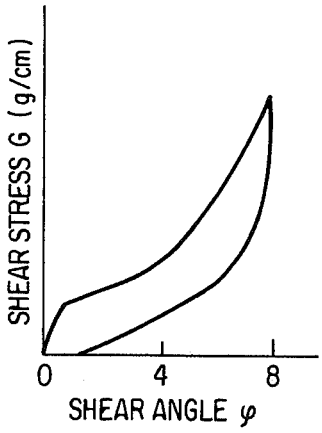
FIG. 16
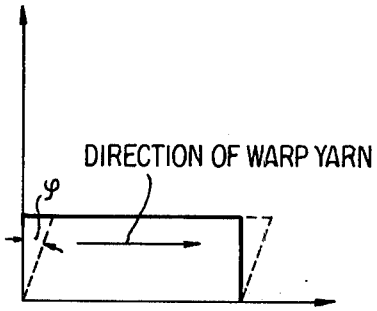
FIG. 17
| | | | | | | | | | |
|---|---|---|---|---|---|---|---|---|---|
| Q | Q | Q | Q | P | Q | Q | Q | Q | P |
| Q | P | Q | Q | Q | Q | P | Q | Q | Q |
| Q | P | Q | P | Q | P | Q | P | Q | P |
| Q | Q | Q | Q | P | Q | Q | Q | Q | P |
| Q | P | Q | Q | Q | Q | P | Q | Q | Q |
| P | Q | P | Q | P | Q | P | Q | P | Q |
FIG. 18

SUEDE WOVEN FABRIC AND A PROCESS OF MANUFACTURING THE SAME

This application is a continuation-in-part of application Ser. No. 705,265, filed July 14, 1976 now abandoned.

BACKGROUND OF THE INVENTION

1. Field of the Invention

The present invention relates to a suede fabric, and especially, relates to a suede woven fabric which is prepared using a woven fabric as a base sheet material.

2. Description of the Prior Art

Hitherto, there has been a general trend to produce a suede fabric whose sheet material is composed of non-woven fabric and rarely is there seen a suede fabric whose base sheet material is composed of woven fabric as in the present invention. Here, it should be pointed out that the base sheet material of the present invention is not composed of knitted fabric. References which disclose a suede fabric which is composed of woven fabric include the British Pat. No. 1,300,268 (this corresponds also to the Canadian Pat. No. 895,611, the West German Pat. No. 2,035,669, the French Pat. No. 2,059,828 and the Netherlands Pat. No. 7,008,329). The British patent claims in claim 1 in the following way. "A pile sheet material comprising a base sheet and a synthetic polymeric superfine fiber pile formed on at least one surface of said base sheet, the pile fibers having a thickness in denier not exceeding 0.5 and a length (in mm) to thickness ratio falling within the range 0.4 to 5000 and being associated in bundles of at least five such superfine fibers." The characteristics of the suede fabric disclosed by the British patent are (a) the pile fibers having the ratio of length (in mm) to thickness (in denier) falling within the range from 0.4 to 5000 and (b) the pile fibers being associated into bundles of at least five superfine fibers. As is clearly understood from FIG. 7 and FIG. 9 of the patent, the condition (b), which is believed to be more important than the condition (a) in the cited British patent, demands the piles of the suede fabric disclosed by the patent to never exist as individual superfine fibers but to exist as bundles of at least five such superfine fibers. This is an essential requirement for the cited British patent to practice the invention using superfine fibers as a raised material. Moreover, the "islands-in-a-sea" type composite fiber which can be used as the raised material in the British patent is disclosed to be prepared using a melt spinning apparatus for molten polymer as shown in FIG. 3 of the patent. Examples of embodiments of composite fibers prepared, using the spinning apparatus, are shown in FIG. 1 and FIG. 2, wherein No. 1 in the figures is called the sea component and No. 2 is called the island component. The island component No. 2 is nothing but the pile fiber and the sea component No. 1 is removed before the raising. As is apparent from FIG. 1 to FIG. 3, the thickness of each island is substantially the same and adjusted to have such a value as not exceeding 0.5 denier. Moreover, in the specification of the British patent, some examples which are very similar to the present invention are disclosed, namely, Example 7 to Example 9. In these examples, at first, a woven fabric for the suede woven fabric is prepared by using a composite fiber as a weft yarn, but not by interlocking pile fibers into a base sheet material of woven fabric separately. Then, a portion of the composite fiber is raised to form pile fibers using a card wire raising machine. However, in those examples, the composite fiber is used as a spun yarn obtained from short fibers (staple fibers) prepared by cutting the composite fiber, but never is used as a filament alone.

The characteristics of the British Pat. No. 1,300,268 are just as mentioned above. Here, the main difference in the structure of suede fabric of the present invention from the said prior patent can be summarized by three points. (a) Although the composite filament of the present invention (multi-islands randomly distributed in the composite filament) also includes multi-islands in the filament similar to that of the prior patent, the mean thicknesses of those islands in denier are different from each other within the range from 0.05 to 0.50 and, accordingly, they are not substantially the same as those of the prior patent. Moreover, against the uniform distribution of islands in the sea in the prior patent, the distribution of islands in the present invention is random. (b) The multi-islands randomly distributed in the composite filament, which is used as a weft yarn for preparing a woven fabric as a base sheet material for suede fabric, is not used as a set of staple fibers as in the prior patent but is used as filament of themselves. (c) Against the fact that each pile of suede fabric in the prior patent exists as a bundle of at least five superfine island fibers, each pile of suede fabric in the present invention does exist individually as an island monofilament whose mean thickness is in the range of 0.05 to 0.50 denier as mentioned above. The characteristic features of the present invention mentioned above make it possible to achieve superior properties in the product of the present invention which are much better than those of the product of the prior patent.

SUMMARY OF THE INVENTION

The suede fabric of the present invention is constructed in the following way.

1. The suede woven fabric of the present invention

A suede woven fabric comprising a warp yarn chosen from polyester textured yarns, polyester filaments yarn and polyester spun yarn, and a weft yarn of polyester island filaments whose mean thicknesses in denier are within the range from 0.05 to 0.50, and whose degree of variation of thickness is 15 to 60% wherein a portion of said island filaments on at least one surface of the fabric is raised to form piles of individual island monofilaments whose mean lengths are 0.5 to 4.0 mm; wherein the number of floating points of the weft yarn, which number is within the range of 3 to 11, is 100 to 500/cm$^2$ of woven fabric; and wherein the relationship between the shear stiffness $G_{0.5}$ at the shear angle of 0.5° and the stiffness $G_5$ at the shear angle of 5°, represented by $G_5/G_{0.5}$, is 1.5 to 15.

2. A typical example of preparing a suede fabric of the present invention

As a fundamental procedure in the present invention, at first, a woven fabric is prepared using a yarn chosen from polyester textured yarn, polyester filaments yarn and polyester spun yarn as a warp yarn, and a single ply yarn blended with two kinds of multi-island, randomly distributed composite filaments as a weft yarn. Each composite filament is previously prepared using a polyester as the island component and another polymer as the sea component which is different in its solubility from that of the island component of polyester. The islands are randomly distributed in the sea component, the island extending substantially along the length of the composite filament and having a mean thickness in denier of 0.05 to 0.50, and a degree of variation of thickness of 15 to 60%. The blending of such composite filaments is carried out so as to obtain a single ply yarn for the weft yarn having a composition of 95 to 40 weight % of islands composed of filaments having a low shrinkability in boiling water and a remainder part of 5 to 60 weight % composed of filaments having a high shrinkability whose degree of shrinkage in boiling water is 3% higher than that of the former. The sea component of the filaments is then removed and a process to heat-set the woven fabric under relaxation is carried out. Finally, a process for raising a portion of the island filaments as a weft yarn on at least one surface of the woven fabric is carried out to form piles of individual island monofilament having a mean length of 0.5 to 4.0 mm. Thus, the suede woven fabric of the present invention can be manufactured.

DETAILED DESCRIPTION OF THE PREFERRED EMBODIMENTS

Figure 1:
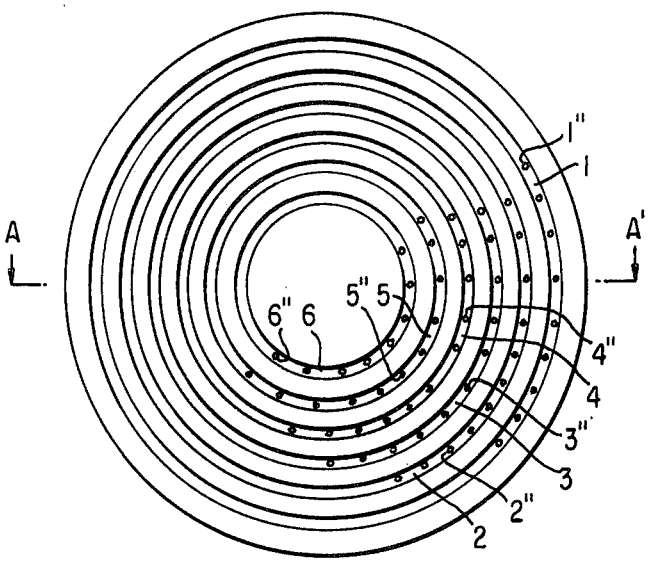

One of the characteristic features of the present invention is the construction of weft yarn of the filament type. If the mean thickness in denier of each island in the composite filament is smaller than 0.05, the purpose of the present invention to get a suede fabric having a proper length of pile cannot be attained. Moreover, this is required because of the breakdown of piles which often happens upon being raised and because otherwise the color appearance after dyeing is inferior. On the other hand, if the mean thickness is larger than 0.50 denier, a texture similar to that of natural leather and a superior writing effect cannot be achieved. Herein, the writing effect refers to the phenomenon of writing letters or figures with a finger by rubbing a raised surface of a suede fabric to bend the piles into the direction of rubbing. Generally, a suede fabric having such a writing effect is believed to be superior. A mean thickness of the islands in the composite filament situated between 0.10 and 0.18 denier, is considered to be proper. In the present invention, the thickness in denier of almost all the islands (such as, more than about 95% of the total islands) contained in the sea of composite filament are necessarily situated within the range from 0.05 to 0.50 and, moreover, the thicknesses in denier of the islands contained in the composite filament are not substantially the same. Here again, it should be pointed out that the degree of variation of thickness of the islands in the sea of composite filament is required to be more than 15% and the desired range is 15 to 60% in the present invention. The degree of variation is the value of thickness deviations in denier of all island filaments from the mean value of the thickness in denier of all island filaments as determined by observation by a photograph of the cross section of the composite filament. The value is represented as a percentage based upon the mean value of the thickness.

When the degree of variation of thickness is less than 15%, it is impossible to get a suede fabric having a natural leather-like touch and a desirable writing effect. On the other hand, when the degree of variation of thickness is larger than 60%, a uniform writing effect can never be achieved. The desirable degree of variation is situated within the range from 20 to 40%. The necessity to set such a limited range in the degree of variation of thickness for the production of suede fabric having a natural leather like touch and a desirable writing effect can be easily understood from the fact that natural leather is composed of numerous fine fibers of collagen and has a superior touch and a nice writing effect because of the existence of a variation of thickness in the diameter of these collagen fibers, ordinary of about 10 to 20%. From the fact mentioned above, it can also be understood that the suede fabric provided by the prior patent mentioned above can never have a natural leather-like touch and a nice writing effect. Rather, it is simply within the level of conventional artificial leather, since the degree of variation of thickness of the islands contained in the sea of the composite fiber manufactured by the prior patent is quite low, 6 to 7% at highest and 3 to 4% ordinarily. In other words, the thicknesses of the islands are substantially same. Therefore, even if the other conditions for manufacturing a suede fabric are sufficiently satisfied, it is impossible to realize the purpose of the present invention when such a composite fiber as prepared by the method of the prior patent is used as a weft yarn. Here, it may be useful to point out that it is, of course, possible to prepare a weft yarn which apparently satisfies the conditions of the present invention, such as one whose mean thickness of islands in denier is within the range from 0.05 to 0.50 and whose degree of variation in thickness in denier is within the range of 15 to 60% by using a combination of a plural number of composite filaments wherein the mean thicknesses of the island filaments of each composite filament are surely within the said range. However, the degree of variation of thickness of those filaments in each single composite filament would be so small as to be situated outside of said range, and, consequently, it would be impossible to realize the purpose of the present invention satisfactorily using such a weft yarn for the preparation of suede woven fabric, since there results non-uniform dyeing or an unevenness in piles coming from an insufficient mixing of island filaments with each other. This is the reason why, in the present invention, a device is made to realize the desired range of the degree of variation of thickness in denier from 15 to 60% in each composite filament itself, thereby not requiring the mixing technique of composite filaments as mentioned above. A composite filament which satisfies the desired condition of the present invention can be prepared by a melt spinning apparatus to be explained below as one embodiment. This apparatus for preparing the composite filament of the present invention is a new device, one very much different from the spinning apparatus disclosed in the prior patent mentioned above.

The melt spinning apparatus of the present invention is provided with a mixing device comprising, a plate A (FIG. 1 and FIG. 2) having at least two polymer outlets of concentric ring structure; a plate B (FIG. 3 and FIG. 4) to be attached just under the plate A, having a concave slit capable of receiving a molten polymer from the plate A, and provided with many polymer inlet holes at the center of said concave slit; wherein the holes are distributed along a circle whose direction coincides with the circumferential direction of said polymer outlets of the plate A; a plate C (FIG. 5, FIG. 6 and FIG. 7) to be attached under the plate B, having channels whose polymer inlets are situated at positions corresponding to the polymer outlet holes of the plate B and moreover, whose polymer outlets are situated along a line not directed substantially parallel to the circumferential direction of the corresponding inlets, a plate D (FIG. 8 and FIG. 9) to be attached under the plate C, having concentric slits of ring structure whereby there are connected each set of a plural number of outlets of the plate C with a specified slit chosen from said slits, wherein said slits have a definite length, not penetrating the plate; and further, another plate B to be attached under the plate D.

Furthermore, the plate B to be attached under the plate D can be, of course, just the same as the plate B to be attached under the plate A, ordinarily, having the same number of fine holes in both cases. However, the former can be somewhat different from the latter; for example, the number of fine holes of the former can be equal to that of a spinning nozzle but different from that of the latter.

The basic principle of mixing of two polymer components in the mixing device described above will be explained below.

The two polymer components, separately fed onto the plate A, are treated in the following way during passing through the mixing device of the present invention. The mixing of the polymer streams can be classified into six stages. They are (1) the formation of alternate multiple layers of the system of two components controlled by the combination of the plate A and the succeeding plate B; (2) the partition of the polymer into many streams by the said combination of the plates A and B; (3) the change in the arrangement of the polymer passages of the plate C; (4) the partition and stretching by the plate D; (5) the gathering of the polymer streams formed by the existence of the concave slits of the plate B succeeding to the plate D; and (6) the partition of the polymer into many streams by said plate B. Thus, each polymer stream of two components after passing through the fine holes of the plate B, that is, after the end of the six stages, has a so-called "islands-in-a-sea" structure. That is, the stream is composed of many island streams *a* in a sea component *b* or many island streams *b* in a sea component *a* which are called "multi-island, randomly distributed, composite filaments" in the invention.

In the following, referring to the attached drawings, a practical example of the mixing device of the invention and the flow of the polymer stream or, in other words, the mixing mechanism, will be explained in more detail.

Figure 2:
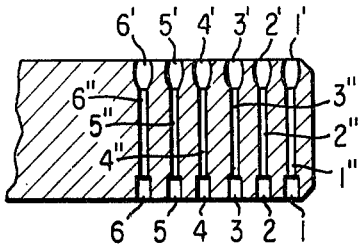

FIG. 1 is a plane figure of a plate A of the present example, showing the outlet side of the plate and FIG. 2 is a vertical sectional view of the plate, obtained by cutting it along the line A—A′ shown in FIG. 1. 1, 2, 3, 4, 5, and 6 are polymer outlets of ring-like slit structure, concentrically prepared on one side of the plate A and 1′, 2′, 3′, 4′, 5′, and 6′ are polymer inlets on the other side of the plate, corresponding to 1, 2, 3, 4, 5, and 6 respectively. FIG. 1 and FIG. 2 show a case where six outlets (six inlets) of slit type are provided. Although the necessary number of outlets (inlets) is at least 2, of course, the more the better from the standpoint of mixing effect. A number from 4 to 20 is desirable or more desirably, from 6 to 15 are used in the present invention. Those outlets and inlets of slit type are connected to each other through the fine holes 1″, 2″, 3″, . . . , penetrating each corresponding sets of outlet and inlet such as 1—1′, 2—2′, 3—3′ . . .

Figure 3:
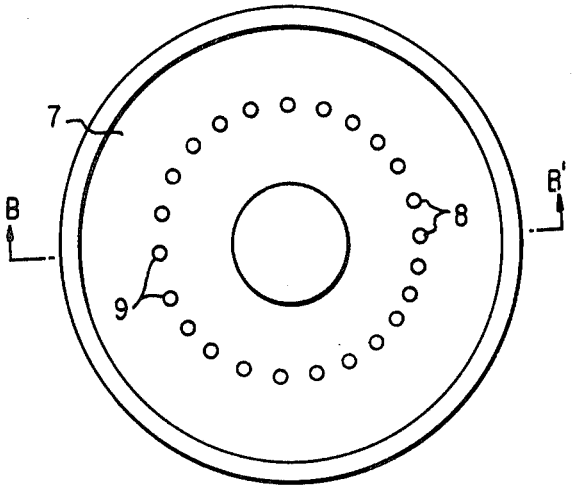
Figure 4:
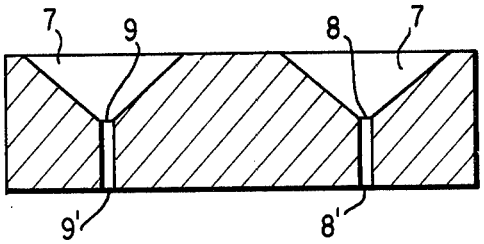

FIG. 3 is a plan view of a plate B and FIG. 4 is a vertical sectional view of the plate B, obtained by cutting the plate along the line B—B′ shown in FIG. 3. 7 is a concave portion of the plate B. However, it is a matter of course that the shape of the concave portion is not limited to that shown in FIG. 3 and FIG. 4. 8 and 9 are polymer inlet holes which are distributed along a circle whose direction coincides with the circumferential direction of the polymer outlets of slit type of the plate A. In FIG. 4, 24 identical inlet holes are provided. 8′ and 9′ are polymer outlets corresponding to 8 and 9, respectively, and the total number of such outlets are, of course, 24 in this case.

Figure 5:
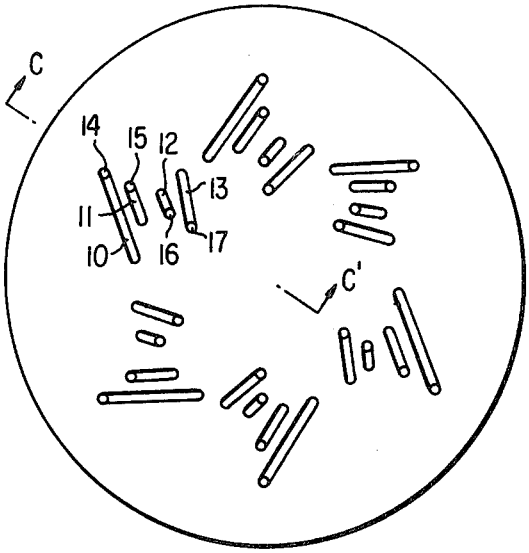
Figure 6:
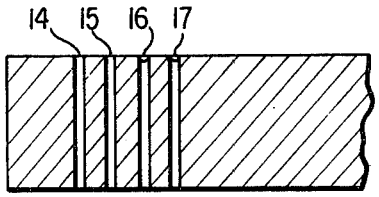
Figure 7:
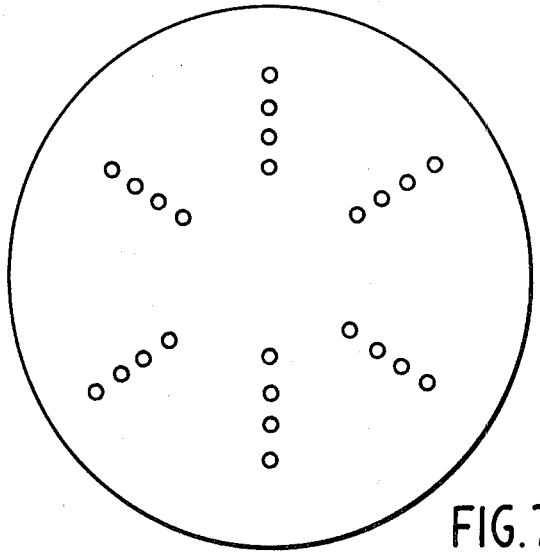

FIG. 5 is a plan of a plate C. FIG. 6 is a vertical sectional view of the plate obtained by cutting it along the line C—C′ and looking at it from the direction shown by the arrow in the figure and FIG. 7 is a plane figure of the outlet side of the plate. 10, 11, 12, and 13 are polymer inlets of channels prepared in the plate C corresponding to the outlets of the polymer of the plate B and in this case, 24 polymer inlets are provided along a circle. 14, 15, 16, and 17 are polymer outlets which are distributed along a line not directed parallel to the circumferential direction formed by the inlets 10, 11, 12, and 13 in this case. Actually, those two directions are almost perpendicular to each other. As shown in FIG. 7, every one set of four polymer outlets are distributed radially and there are six such sets in the plate C or the plate C has 24 polymer outlets.

Figure 8:
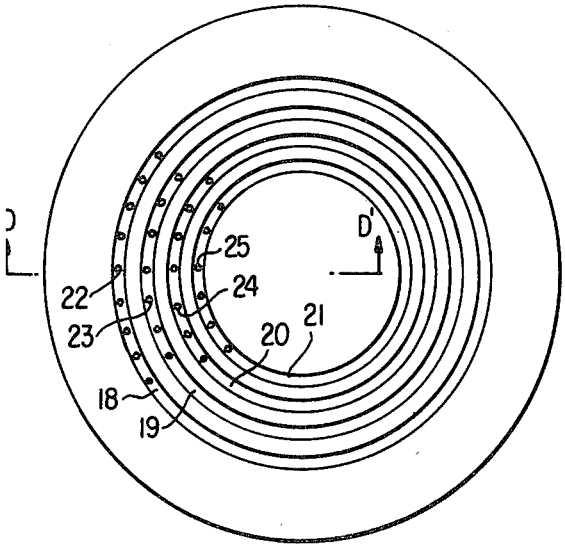
Figure 9:
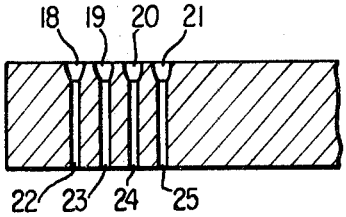

FIG. 8 is a plan of a plate D and FIG. 9 is a vertical sectional view of the plate D obtained by cutting it along the line D—D′; 18, 19, 20, and 21 are concentric channels of ring type prepared on the upper surface of the plate D. As shown in FIG. 8 and FIG. 9, in this case, four channels are provided, which do not penetrate the plate D, forming slits of ring type. Many fine holes 22, 23, 24, and 25, etc. penetrate it. These are provided along the bottoms of those channels. And moreover, in case of this example, 180 fine holes in total are provided at the bottoms of the four channels of ring type. However, it is, of course, possible to use other types of plates as the plate D such as, for example, a plate which has concentric circular channels at the both sides of the plate.

By attaching, further, a plate B just under the plate D, a mixing device of the present invention can be a set of minimum units. If it is necessary, a spinning nozzle, having fine orifices at the positions just corresponding to the polymer outlets of the said plate B, can be used attached it under the plate B. Incidentally, in the attached drawings, many portions of similar structure or symmetrical portions are omitted for simplification except where inconvenience for the explanation of those drawings is caused.

Here, the flow of polymer having two components, *a* and *b*, in the mixing device will be explained.

Two polymer streams of the components *a* and *b* are, separately, introduced into the polymer inlets of the plate A, alternately; for example, in such a way that *a* is introduced into 1′, 3′ and 5′ and *b* into 2′, 4′ and 6′, each in a definite amount measured by a metering group (gear pump). Then the polymer enters into the concave portion of the plate B, being extruded from the outlet slits of the concentric ring structure of the plate A, forming a composite stream of six layers conjugated with each three layers of *a* and *b* components, alternately side by side. The direction of the conjugated interface of the composite conjugate stream is the same as that of the center line of the inlet holes of the plate B, or in other words, to the circumferential direction of the plate B.

In this case, the six layers of the composite conjugate stream, of course, come from the number of polymer outlets (or inlets) of slit type in the plate A. Therefore, it is easily possible to prepare a composite conjugate stream of more multiple layers corresponding to the number of outlet (inlet) slits if the number is increased to a desired number and the feeding of the two components is carried out alternately into inlet slits as explained above.

The polymer stream entering into the concave portion 7 of the plate B of FIG. 4 is introduced into the 24 polymer inlet holes, having the same structure as that of 8 or 9 in the figure and distributed along a circle. Then the polymer is extruded from the 24 polymer outlets whose structures are identical to those of 8' and 9'.

The polymer stream passing through the plate A, is treated to increase the number of alternate multiple layers and partitioned into 24 streams during passage through the plate B.

The 24 polymer stream extruded out from the outlets of the plate B, separately, enter into the corresponding polymer inlets, such as 10, 11, 12, 13, etc. of the plate C shown in FIG. 5. These inlets are distributed along a concentric circle of the plate C of disc type. The total number of 24 is the same as the number of the entering streams. The polymer streams pass through the channels and then go out from the outlets such as 14, 15, 16, and 17, wherein, as mentioned already, the polymer outlets are distributed along a line not directed substantially parallel to the circumferential direction formed by the polymer inlets. In this case, every set of four polymer outlets are distributed radially and the plate C has such six sets or has 24 outlets in total. Here, the arrangement of the polymer streams is changed from the initial circular arrangement to the radial arrangement, forced by the existence of the plate C. This rearrangement is an important feature in order to perform the stretching effectively in the succeeding plate D. The polymer streams after passing through the plate C enter into the polymer inlets of the channels of the concentric ring structure 18, 19, 20, and 21 of the plate D attached just under the plate C.

Upon passing through the plate D, the polymer streams are sufficiently stretched in the channels of the concentric ring structure in the circumferential direction and then partitioned into fine polymer streams by the many fine holes such as 22, 23, 24, 25, etc., provided in regular arrangement along the circumferential direction in the channels of concentric ring structure. In this case, the total number of fine holes distributed into the 4 channels is 130.

The fine polymer streams formed by passing through the plate D enter into the plate B attached just under the plate D and again are gathered into a polymer stream in the concave portion of the plate B and successively partitioned into so many polymer streams just corresponding to the number of fine holes provided at the center of the channels of the plate B, that is, 24 in the present example.

As mentioned above, the polymer consisting of two components a and b, is effectively and moreover in a well-controlled state, mixed together by passing through the mixing device of the present invention. Here, the degree of mixing is considered to be a function of the number of fine polymer streams capable of being partitioned without any interruption in practice. It is, of course, clear that an effective mixing makes it possible to get many fine streams of polymer or inversely, when it is possible to get so many fine streams, regularly, the degree of mixing is high. Each island filament in the sea of the composite filament obtained by the method of the present invention is observed to exist as a continuous phase, practically as an endless filament extending along the length of the composite filament.

The polymer component which forms the islands of the composite filament in the present invention is a polyester. Practical examples include those polyesters which can be obtained by the polymerization of aromatic dicarboxylic acids such as terephthalic acid, isophthalic acid or their esters and/or aliphatic acids such as adipic acid, sebacic acid or their esters and diols such as ethylene glycol, diethylene glycol, 1,4-butanediol, neopentyl glycol, cyclohexane-1,4-dimehtnaol, etc. Among them, polyesters whose structural units are composed of more than 80% of ethylene terephthalate, are desirable. Furthermore, besides those components for polymer synthesis mentioned above, such compounds as polyalkylene glycol, bisphenol A, sulphoisophthalic acid, etc. can also be used as a component for copolymerization, and not more than 5 weight % of other additives such as delustering agents, heat stabilizers, pigments, etc. or anti-static agents such as polyethylene glycol having

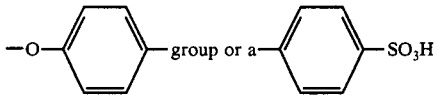

group at its molecular end, dodecyl benzene sulphonic acid, etc. can be used by adding the same in a polymerization reaction system.

The polymer component which constitutes the sea of the composite filament of the present invention should have a solubility characteristic different from that of the polyester island component mentioned above. Examples of such polymers include polyolefins such as polyethylene and polypropylene, atactic or isotactic polystyrene, alkyl-substituted or halogen-substituted polystyrene, etc.

The composite filament, prepared by the method explained above can be used in the present invention, has almost the same cross-sectional diameter at any position of the filament along the longitudinal axis. FIG. 10 shows a diagrammatic view of an example, wherein 26 is the sea and 27 is one of the island filaments. As is apparent from the figure, the islands in the sea of the composite filament are different each other in their thickness in denier and are distributed randomly in the sea. It should be pointed out that the number of islands in the composite filament of the present invention is within the range from 5 to 100 or preferably, is 20 to 50. When the number of islands is more than 100, it becomes rather difficult to get a suede fabric having the superior surface condition desired for the present invention, since the mean thickness in denier of the island filament becomes too small if the total thickness in denier of the islands is constant.

In the present invention, the blending of such composite filaments as mentioned above, is carried out during a spinning step or a stretching step or during a twisting step, so as to get a single yarn for the weft yarn, finally having such a composition that 95 to 40 weight % of the islands are composed of filaments having a low shrinkability in boiling water and the remaining part of 5 to 60 weight % is composed of filaments having a high shrinkability wherein the difference of degree of shrinkage in the two kinds of composite filaments should be more than 3%. That is, it is most preferred to use such a single ply yarn, which contains a mixture of island filaments having different shrinkabilities, high and low, for manufacture of the suede woven fabric of the present invention. Such a single ply yarn in the present invention is well known in the field of textile industry that is, it is a kind of twisted yarn which can be prepared by twisting one or a plural number of substantially untwisted multi-filaments. As mentioned already, the present invention clearly uses the single ply yarn obtained by blending composite filaments but never uses a ply yarn known as two-ply yarn, three-ply yarn, etc. in the field of the textile industry.

Methods suitable for producing a difference in shrinkability of island filaments in a single ply yarn include, for example, the following: 1) two kinds of undrawn composite filaments are prepared, at first, by the spinning of a polymer mixture but at two different draft ratios and then are stretched at the same time, plying them together; 2) two kinds of undrawn composite filaments are prepared, at first, using two kinds of island components which are different from each other in their shrinkability in boiling water and then are stretched at the same time, plying them together; 3) one kind of undrawn filament is strecthed under two different thermal conditions and then, the two kinds of stretched filaments obtained are twisted together; and 4) about one half of a type of stretched filament is heat-treated for shrinkage and then twisted together with an equal amount of said filament.

After preparing a woven fibric using a single ply yarn as mentioned above as a weft yarn, the sea component is removed from the fabric. Then the fabric is heat-treated for relaxation setting. Here, the filaments of the island component having a high shrinkability shrink considerably. They gather into the center of the yarn in the structure of the fabric. On the other side, the filaments of the island component having a low shrinkability come to the surface of the fabric forming loops having a length corresponding to the shrinkage difference. However, since each island monofilament has only a small freedom for moving at each point of fabrication which is stamped by the warp in the fabric, the island filaments having a high shrinkability shrink in such a way as to intermingle the island filaments having a low shrinkability within them. Thus, many loops are formed between two fabricated points. Afterwards, these loops are changed to long piles during the raising treatment. Furthermore, since these piles are strongly bound at every fabrication point, they never drop off.

In order to prepare the loops mentioned above in an appropriate manner, it is desirable that 95 to 40 weight % of the island filaments have a low shrinkability and that the remainder, that is, 5 to 60 weight % of the filaments, have a high shrinkability. If the content of high shrinkage filaments is less than 5%, an unsatisfactory formation of loops can occur as well as an insufficient nipping of the low shrinkage filaments at the fabricated points, since the compression force due to the shrinkage is too small. On the other hand, if the content is larger than 60%, there is a tendency for the number of loops to decrease. Accordingly, a suede woven fabric having rather a small number of piles is produced. In the present invention, a desirable range of the content of the high shrinkage filaments is 20 to 50 weight %. The difference of the degree of shrinkage in the two kinds of composite filaments in boiling water should be more than 3%. When the difference is less than 3%, each loop becomes small and, accordingly, a suede woven fabric having rather short piles only can be obtained. This is not desirable. In the present invention, a difference of more than 5% is especially desirable.

The degree of shrinkage in boiling water referred to in the present invention is the degree of shrinkage of the multi-island, randomly distributed composite filament yarn treated in boiling water at 100° C. for 10 min. without applying any load and determined by the following relations.

The degree of shrinkage in boiling water (WSr) = $(10-1/10) \times 100(\%)$, wherein 10 is the initial length of the yarn before treatment observed under a load of 2 mg/d and 1 is the length of the yarn after the treatment, observed under a load of 2 mg/d. Furthermore, it is more desirable in the present invention to use a single ply yarn composed of two kinds of composite filaments whose degrees of shrinkage are different by more than 3%, as mentioned above, after twisting it within the range of from 50 to 500 turns/m. By twisting the yarn more than 50 turns/m, it becomes possible to get a suede woven fabric having piles which only rarely drop off even if they are rather long. However, when the number of twists is more than 500 turns/m, although the dropping-off of piles can almost be prevented totally, the raising treatment becomes rather difficult. For the warp yarn, conventional polyester textured yarn, polyester filaments yarn and polyester spun yarn can be used in the present invention.

For the structure of the woven fabric, those structures which permit many weft yarns to appear on the surface of the fabric are desirable. An example of such is satin weave.

As already mentioned, the present invention uses a single ply yarn composed of two kinds of composite filaments as the weft yarn. In this case, the thickness after removing the sea component of the single ply yarn is preferred to be 75 to 500 denier, or more desirably, is 150 to 350 denier. Incidentally, the present invention does not use any two ply yarn or three ply yarn composed of composite filaments as the weft yarn, since it is almost impossible to get a suede fabric having individual piles in contrast to the case where a single ply yarn is used as the weft yarn as in the present invention.

In the suede woven fabric of the present invention, since it is desirable to have about 5 to 40%, more desirably about 5 to 15%, of the total number of island monofilaments which constitute the weft yarn of the fabric, to be cut at every floating point in order to raise them as piles, the desirable number of island monofilaments which constitute the weft yarn is 500 to 10,000, or more desirably is 1000 to 6000. Moreover, the weft yarn is desired to have 50 to 500 turns/m of twist or more preferably, 75 to 200 turns/m.

Herein, the floating point of the weft yarn is that weft yarn between two fabricated points appearing on the surface of the woven fabric. The number of floats is the number of warp yarns which exist under the floating weft yarn. The number of floatingpoints on weft yarns having a number of floats from 3 to 11 is determined from the construction of the woven fabric and its density. That is, the number of floating points on weft yarns per cm$^2$, A is given by the following equations.

$$A = N \cdot M \frac{\sum^{m} l_{ai}}{nm}$$

wherein N is the warp yarn density (yarns/cm), M is the weft yarn density (yarns/cm), n is the number of warp yarns per cycle, m is the number of weft yarns per cycle, and Ai is the number of floating points per one cycle of the number i of weft yarns. For example, in the case of a satin shown in FIG. 11 (which denotes a single cycle of 3-counter, 5-end weft satin weave), wherein the weft yarns appear on the surface of the fabric much more often than the warp yarns, A is given by the following relation.

$$n=m=5,\ a_1=a_2=a_3=a_4=a_5=1\ A = N.M/5\ (\mathrm{cm}^{-2})$$

Even if there exist a considerable number of floating points on weft yarns whose number of floats is less than 3, the piles obtained from those floating filaments are not useful for manufacturing a suede woven fabric having a satisfactory writing effect since those piles are too short. On the other hand, the lie of the piles obtained from those floating points on weft yarns whose number of floats is more than 11 becomes rather irregular and does not contribute to the successful manufacture of a natural leather-like suede woven fabric which is the object of the present invention. Therefore, the number of floating points on weft yarns whose number of floats is outside the range from 3 to 11, is excluded from the value of A in the above equations.

When the value of A is less than 100/cm$^2$, the suede woven fabric obtained has a lot of long piles and the appearance of the fabric is inferior. Accordingly, this cannot satisfy the object of the present invention. On the other hand, when A is larger than 500/cm$^2$, the piles obtained are too short to cover up the inner structure of the fabric, and accordingly, this cannot achieve the object of the present invention.

The mean length of piles of the suede woven fabric of the present invention is in the range from 0.5 to 4.0 mm. If the length of piles is shorter or longer than the range, the suede woven fabric of the present invention can never be obtained. Moreover, it is desired, for the purpose of the present invention, that the distribution of pile length be as narrow as possible. The length of pile can be easily observed experimentally using a microscopic observation of a weft yarn taken from a fabric. FIG. 12 and FIG. 13 are indicative, wherein FIG. 12 is a picture of a weft yarn taken from a suede fabric of the present invention and FIG. 13 is a comparative example of a picture of a weft yarn taken from a fabric prepared by using a spun yarn composed of staple fibers whose lengths are 51 mm. The narrow distribution of pile lengths desired in the present invention, as mentioned above, can be clearly understood from these microscopic pictures. That is, the piles 28 shown in FIG. 12 have almost the same definite length, whereas the length of the piles 28 shown in FIG. 13 are very much different from each other. In FIG. 13, although the length of the piles can be cut by shearing at almost constant length, the suede fabric obtained by this treatment still shows only a poor appearance different from the one of this invention or from natural suede.

The other important factor necessary for the suede woven fabric of the present invention relates to the shear stiffness of the fabric. Three examples of shear stress-strain (angle) curves are shown in FIG. 14 to FIG. 16. FIG. 14 is a curve of a conventional fabric, FIG. 15 is a curve of a natural suede or an artificial leather and FIG. 16 is a curve of a natural leather-like suede woven fabric of the present invention. These curves were obtained under the following conditions.

| | |
|---|---|
| Apparatus | Shear Stress Tester KES-F1 (manufactured by Kato Iron-Works Corp.) |
| Conditions | Shear Velocity = 0.417 mm/sec, max. shear angle = 8°, uni-axial tension - 10 g/cm (constant), sample size - 20 cm × 4 cm. |
| Remarks | as shown in Figure 17, the shear stress is applied to the direction parallel to the direction of the warp yarn. |

Herein, the shear stiffness at the shear angle of 0.5° will be denoted as $G_{0.5}$ and that at the shear angle of 5° will be denoted as $G_5$*. The value of of ratio $G_5/G_{0.5}$ is an important consideration. As shown in FIG. 14, for the conventional fabric, the stress-strain curve, excluding the initial stage wherein the curve is rising up rapidly, (this large resistance to initial deformation surely shows the existance of a rather geometrically rigid three dimensional structure of the fabric due to the intimate contact or entanglement between yarns which, however, can be easily destroyed), rises gradually in a straight line. Therefore, the value of $G_5/G_{0.5}$ is almost equal to 1. On the other hand, for natural suede or artificial leather, since fibers are tightly entangled with each other and never flow by releasing each other, the rapid increase of the shear-stress curve continues up to 3°–5° of shear angle as shown in FIG. 15 and then the stress increases gradually, displaying the so-called buckling phenomenon. Therefore, the value of $G_5/G_{0.5}$ is less than 1 in this case. In contrast to these phenomena, the fabric of the present invention shows a characteristic behavior as shown in FIG. 16 and the value of $G_5/G_{0.5}$ is within the range from 1.5 to 15. * The stress-strain curve of the fabric of this invention up to about 2°–4° of shear angle is almost similar to that of the conventional fabric shown in FIG. 14** and also the value of $G_{0.5}$ is nearly equal to that of the conventional one. However, the stress-strain curve again begins to rise rapidly when the shear angle exceeds this range and the value of $G_5/G_{0.5}$ becomes more than 1.5. Moreover, no buckling phenomenon can be seen. That is, the suede woven fabric of the present invention has a sufficient draping property and softness as a textile fabric while at the same time it has a proper initial Young's modulus very similar to natural suede. Surely, this is a new material for clothes.

The shear stiffness at the shear angle of 0.5° and 5° are calculated by shear stress/shear angle 1° at the slope of the stress-strain curve at the shear angle of 0.5° and 5° respectively. Therefore, the unit of the shear stiffness is g/cm.degree.

Buckling phenomenon means that the fabric shows some wrinkles on the surface of the fabric when the shear stress is applied to the direction parallel to the fabric and the shear angle is in excess of special values. It is known that the fabric has poor draping property and softness if the buckling phenomenon occurs under low shear angle.

The shear stiffness $G_{0.5}$ and $G_5$ of the fabric belonging to the invention are exemplified in FIG. 16, that is, $G_{0.5}$ is sheer stress 1.2 (g/cm)/shear angle 1° (degree) = 1.2 (g/cm.degree), and $G_5$ is shear stress 4.2 (g/cm) shear angle 1° (degree) = 4.2 (g/cm.degree) respectively. Therefore, $G_5/G_{0.5}$ is equal to 3.5 as shown in following Example 1.

The suede woven fabric of the present invention, which has the characteristics mentioned above, can be manufactured in the following way.

At first, a woven fabric is prepared, using any one chosen from the group of polyester textured filaments yarn, polyester filaments yarn and polyester spun yarn as a warp yarn and a single ply yarn composed of composite filaments as a weft yarn as mentioned above, wherein the construction and the density of the fabric are designed so as to have a number of floating points on weft yarn, whose number of floats is within the range from 3 to 11, that is, the value of A defined before as 100 to 500/cm$^2$. Then, the removal of the sea component in the composite filaments is carried out by dissolving it with a solvent for the sea component or by decomposing it with a decomposing agent, such as acids, alkalis, oxidizing agents or water-containing surface active agents, or by treating it mechanically, for example, by rubbing. After the removal of the sea component, the fabric is heat-set. Next, a raising process also effecting buffing is carried out. For the raising, it is desirable to use a raising machine such as a double type card-wire raising machine comprising a pile roller and a counter pile roller. It is especially desirable to carry out the raising in such a way that, at first, the raising treatment is carried out repeatedly for 3 to 10 times, increasing its strength from weak to medium and finally to strong. Then, turning the direction of the fabric inversely, another raising treatment is carried out for 2 to 8 times increasing its strength from medium to strong. Further, the addition of a temporary anti-staic agent or a raising agent or the execution of a tentering treatment to remove wrinkles before the raising treatment is also desirable to carry out the raising treatment effectively. After the raising, the fabric is dyed and at last, finished.

The thus obtained suede woven fabric of the present invention can be treated further for special finishings. These include, for example, a treatment with resins such as acrylate resin, vinyl acetate resin, urethane resin or melamine resin as an agent for preventing the dropping-off of piles; an addition of 0.5 to 10% of cationic compounds, anionic compounds, non-ionic compounds, polyamine compounds, silicone compounds, etc. as a softening agent, an anti-static agent or a feeling control agent; a treatment of the piled surface of the suede woven fabric by card wires or a brush in order to give the piles a direction; and a treatment of the piles by a hot roller, hot press, calender roll or a decatizer in order to set the same direction for each pile and at the same time to give the piles an elegant lustre. These specially trested suede woven fabrics are, of course, within the scope of the present invention.

In the following, the invention will be explained in more detail through several examples.

EXAMPLE 1

At first, two kinds of composite multi-filament yarns, each comprising 24 filaments, were prepared by melt spinning a polymer mixture consisting of 60 weight % of polyethylene terephthalate as the island component whose [$\eta$] (the intrindic viscosity of the polyethylene terephthalate dissolved in a solvent mixture consisting of equiamounts of phenol and tetrachlorethane, observed at 30° C. in a thermostat, using a Ubellohde's viscometer) was 0.60 dl/g, and 40 weight % of polyethylene produced by a high pressure method, as the sea component, using the melt spinning apparatus shown FIG. 1–FIG. 9 and by drawing. The two kinds of composite filaments obtained were, of course, substantially untwisted and had a structure of multi-islands randomly distributed similar to that shown in FIG. 10 and had the following differing properties. That is, the number of island filaments of one of them (X) was 48, the mean thickness in denier of these island filaments was 0.13; the degree of variation of thickness in denier of the island filaments was 32% and the degree of shrinkage of the composite filament in boiling water (WSr) was 18%. The number of island filaments of the other (Y) was 42, the mean thickness in denier of those filaments was 0.15, the degree of variation of thickness in denier of the filaments was 36% and the degree of shrinkage of the composite filament in boiling water was a low 8%. A multi-filament single ply yarn to be used as a weft yarn was prepared from the two kinds of composite filaments (X) and (Y) mentioned above, plying them together and twisting with 300 turns/m. Using the said single yarn as a weft yarn and a conventional polyester false twist yarn as the warp yarn of 150*d*/48*f*, a satin fabic similar to that shown in FIG. 11 was prepared. In FIG. 11, P denotes a floating warp yarn and q denotes floating weft yarn. After treating the satin fabric in boiling water for thermal relaxation, the polyethylene contained in the fabric as the sea component was extracted with toluene at 80° C. and successively, the fabric was previously set at 180° C. After adding an anti-static agent to the satin fabric, a raising treatment was carried out on one surface of the fabric, 10 times repeatedly using a raising machine of a card wire system. Thus, island filaments were uniformly raised as individual island monofilaments on the surface of the stain fabric. It was completely impossible to determine the inner structure of the fabric through piles from the outside. In this example, after a dyeing treatment, and after adding to each a certain amount of acrylic resin and anti-static agent, the suede fabric was again treated three times for raising.

Since the prepared satin fabric had warp yarn and weft yarn densities of 120 and 75 yarns/inch respectively and the number of floats was 4 as seen in FIG. 11, the value of A was estimated to be 297/cm$^2$. Moreover, the observed values of $G_{0.5}$ and $G_5$ of the obtained suede fabric were respectively 1.2 g/cm.degree and 4.2 g/cm.degree and, accordingly, $G_5/G_{0.5}$ was estimated to be 3.5. As shown in FIG. 12, the length of pile was almost uniform and the pile length distribution was believed to be very narrow. The mean length of piles was observed as 1.5 mm.

The obtained suede woven fabric had a soft surface completely covered with fine piles and showed a very superior writing effect.

The surface condition of the obtained suede woven fabric was concluded to be very similar to that of sheep suede. A blazer coat prepared from the obtained suede fabric was, of course, soft and flexible but was rather expansive and the comfortability in wearing and its draping property were about similar to clothes of ordinary woven fabric. The suede woven fabric of the present invention was worth being tailored into such a coat, etc. since it had a proper resistance to bending and had a nice high class, suede touch, of course, not similar to the feeling of ordinary woven fabric and also somewhat different from that of natural leather. Though the blazer coat was washed in a cleaning test three times during a wearing test for one month, difficulties such as recognizable changes in the initial tailoring did not occur and the piles recovered their original state by simply brushing, without forming any pilling.

COMPARATIVE EXAMPLE 1

A suede woven fabric was obtained from a process similar to Example 1 except that the extraction of the sea component and raising treatment were processed in reverse order. Thus, the island filaments were raised as bundles on the fabric and it was easily possible to determine the inner structure of the fabric through the bundle piles. The values A and $G_5/G_{0.5}$ of the fabric were 235/cm² and 1.30 respectively. Since the piles were formed with bundles, pilling occurred considerably and the appearance of the suede surface became ugly.

COMPARATIVE EXAMPLE 2

A staple fiber shown in the following description was prepared from a multi-island uniformly distributed composite filament whose number of islands was 26 obtained by the spinning of a polymer mixture using a spinning apparatus shown in the British Pat. No. 1,300,268.

| | |
|---|---|
| Sea component | polyethylene |
| Island component | polyethylene terephthalate |
| Mean thickness in denier of island filaments | 0.15 |
| Degree of variation of thickness in denier of islands | 7% |
| Mean length of staple fiber | 51 mm |
| Mean number of crimps of staple fibers | 8/inch |

Then, a woven fabric was manufactured and treated for raising under the same conditions as in Example 1, except that, as the weft yarn, a 20'S two ply spun yarn prepared from the staple fiber obtained above was used and a raising treatment was carried out 5 times in one direction. The obtained fabric had a value of A of 311/cm², of $G_5/G_{0.5}$ of 1.13 and the mean length of piles was 4.5mm. The distribution of pile length was rather broad, almost similar to that shown in FIG. 13. Although the piles had a tendency to orientate and accordingly, had a writing effect, the center of each pile curled as if forming a pill. Therefore, the appearance of the piled surface of the fabric was not good. By turning the piles into the reverse direction to their preferred direction, it became possible to see the inner structure of the fabric. Furthermore, as can be understood from the value of $G_5/G_{0.5}$, the feeling of the fabric regarding bending deformation was almost the same as that of the conventional woven fabric. Accordingly, the suede fabric of comparative Example 2 was not worth tailoring into a blazer coat since its resistance to bending was too small. Furthermore, pilling occurred considerably. For example, after 2 days in a wearing test, the appearance of the suede surface became ugly.

As mentioned above, the raising treatment was stopped after being repeated 5 times in one direction only as in Comparative Example 2. A further trial to carry out the raising treatment into the reverse direction was not successful since the dropping of piles was so violent.

Furthermore, another trial to make the length of the piles less than 3 mm by shearing after the brushing was also not successful, since very often such difficulties as the fabric shearing machine occurred cutting off the selvage portion of the fabric by the shearing machine or a portion of the base sheet of the fabric invaded into the machine. Furthermore, in another trial, to increase the value of $G_5/G_{0.5}$ of the suede fabric by the use of a certain amount of urethane resin in place of the acrylic resin, no success occurred since the value, $G_5/G_{0.5}$, became smaller than 1 because of the increase of $G_{0.5}$, contrary to the purpose of the trial.

EXAMPLES 2, 3, 4, AND 5 AND COMPARATIVE EXAMPLES 3 AND 4

Satin fabrics identical to the fabric of Example 1 were prepared, wherein there was used as the weft yarn, a single ply yarn composed of two kinds of multi-island randomly distributed composite multi-filament yarns, X and Y as shown in Table 1, whose island filaments were substantially continuous in each sea, and consisted of polyethylene terephthalate whose [η] was 0.62 dl/g as the island component and polystyrene as the sea component, the warp yarn, a conventional polyester false twist yarn of 150*d*/48*f* was used. The woven fabric was treated in tetrachloroethylene at 40° C. to remove the styrene contained in the fabric as the sea component and then after pre-setting it at 160° C., a raising treatment was carried out. After dyeing the fabric, a further raising treatment was carried out 2 times and successively, brushing was done. The yarn denisty, the number of floats and the value of A of the obtained fabric were identical to those of the fabric obtained in Example 1. Other important conditions are summarized in Table 1. Also various properties of the obtained fabrics in these examples are also summarized in Table 2.

Table 1

| | Composite Filament X | | | Composite Filament Y | | | | | | | |
|---|---|---|---|---|---|---|---|---|---|---|---|
| | Mean thickness of island filaments (denier) | Degree of Variation of thickness of islands (%) | WSr (%) | Mean thickness of island filaments (denier) | Degree of Variation of Thickness of islands (%) | WSr (%) | X/Y | Number of Twists (t/m) | Number of repeated Raising | Mean Length of piles (mm) | $G_5/G_{0.5}$ |
| Ex. 2 | 0.2 | 28 | 13.0 | 0.2 | 36 | 7.2 | 25/75 | 100 | 9 | 1.8 | 4.1 |
| Ex. 3 | 0.5 | 33 | 16.0 | 0.2 | 40 | 8.5 | 40/60 | 300 | 9 | 1.6 | 3.6 |
| Ex. 4 | 0.14 | 39 | 9.5 | 0.14 | 32 | 10.0 | 40/60 | 300 | 13 | 2.0 | 4.3 |
| Ex. 5 | 0.15 | 33 | 9.5 | 0.15 | 33 | 9.5 | 50/50 | 250 | 13 | 2.2 | 3.5 |
| Comp. Ex. 3 | 0.03 | 26 | 9.2 | 0.02 | 30 | 8.5 | 50/50 | 280 | 14 | 0.4 | 1.4 |
| Comp. Ex. 4 | 0.15 | 6 | 8.3 | 0.15 | 7 | 8.0 | 50/50 | 250 | 13 | 2.0 | 1.3 |

Table 2

| | Length of piles | Plentity of piles | Dropping of piles | Writing effect | Pilability | Appearance | Touch |
|---|---|---|---|---|---|---|---|
| Ex. 2 | 2A | 2A | no | 2A | 2A | 2A | 2A |
| Ex. 3 | A | 2A | no | 2A | 2A | 2A | 2A |
| Ex. 4 | 2A | 2A | no | 2A | 2A | 2A | 2A |
| Ex. 5 | 2A | 2A | no | 2A | 2A | 2A | 2A |
| Comp. Ex. 3 | −2A | −2A | yes | −A | −2A | −2A | −A |

Table 2-continued

| | Length of piles | Plentity of piles | Dropping of piles | Writing effect | Pila-bility | Appear-ance | Touch |
|---|---|---|---|---|---|---|---|
| Comp. Ex. 4 | −A | A | no | A | −A | A | −A |

Note:
The evaluations were done with the naked eye and by touch. Four grades of suede fabrics, 2A (better or best), A (good), −A (bad) and −2A (worse or worst), were determined comparing them with 14 kinds of natural suedes from sheep, calf, chamois and dog as references.

EXAMPLE 6

Although in Example 1, two kinds of composite filaments X and Y were used to compose the single ply yarn used as the weft, in this example, a multi-filament single ply yarn of 48*f* composed of only the composite filament X in Example 1 was prepared. Using this single ply yarn as the weft yarn and a polyester false twist yarn of 150*d*/48*f* as the warp yarn, a woven fabric whose construction was the same as that of Example 1 was woven and treated for raising in the same way as in Example 1, wherein only the yarn density of the fabric was changed from that of Example 1. The results obtained are shown in Table 3.

EXAMPLE 7 AND COMPARATIVE EXAMPLES 5 AND 6

In these examples, suede woven fabrics whos structures were the same as the structure of the fabric of Example 6 but whose yarn densities were somewhat different from the latter, were prepared as in Example 6, using various composite filaments X as the weft yarn, wherein those composite filaments X were different from the composite filament X used in Example 6 in their mean thickness in denier as shown in Table 3. The results obtained in these examples together with those of Example 6 are shown in Table 3.

Table 3

| | Mean Thickness of island filaments (denier) | Degree of Variation of Thickness of island filaments (%) | WSr (%) | A (/cm²) | Number of floats | Mean Length of piles (mm) | $G_5/G_{0.5}$ |
|---|---|---|---|---|---|---|---|
| Ex. 6 | 0.13 | 32 | 18 | 273 | 4 | 1.8 | 3.00 |
| Ex. 7 | 0.40 | 28 | 9 | 301 | 4 | 2.5 | 2.19 |
| Comp. Ex. 5 | 0.03 | 30 | 11 | 286 | 4 | 0.7 | 1.12 |
| Comp. Ex. 6 | 0.70 | 21 | 11 | 291 | 4 | 3.3 | 1.41 |

The mean length of the piles of Comp. Example 5 was too small so that it was possible to see the inner structure of the fabric through the piles. Accordingly, the dyeing effect of the fabric was unsatisfactory and, moreover, the lustre of the piled surface was not good. As can be understood from the value of $G_5/G_{0.5}$, since the suede fabric of Comp. Example 5 was too soft, it is inferior in touch and also in resistance to deformation. The suede woven fabric of Comparative Example 6 had no writing effect and its touch was very similar to that of wool fabric of cashmere quality.

The suede woven fabrics of Example 6 and Example 7 of the present invention were very similar to natural suede in their appearance and surface condition and, on the other hand, were very similar to the ordinary woven fabric in flexibility and draping property.

COMPARATIVE EXAMPLE 7

A suede woven fabric was prepared in the same way as in Example 6, except that the construction of the woven fabric was 2/1-twill and the warp and weft densities were 98 and 65 yarns/inch respectively. Since the number of floats of the woven fabric was 2, the value of A was estimated to be zero. The observed value of $G_5/G_{0.5}$ was 1.15 and the mean length of the obtained piles was 0.30 mm.

For the suede woven fabric obtained it was possible to see the inner structure of the fabric through the piles, since they were so short. Moreover, the value of $G_5/G_{0.5}$ was as small as 1.15, very similar to that of ordinary woven fabric having piles since the piles of the suede fabric obtained had no ability of play the important role desired for them.

COMPARATIVE EXAMPLE 8

A woven fabric of 13-ends weft weave was prepared as the weft yarn using a composite multi-filaments yarn of 150*d* having a twist of 100 turns/m, whose mean thickness in denier of island filaments was 0.18 and degree of variation of thickness was 21%. A polyester false twist filaments yarn of 75d/36f was used as the warp yarn and the fabric was treated for raising after removing the sea component. The results obtained were 94 for the A value, 3.1 mm for the mean length of piles and 1.51 for the $G_5/G_{0.5}$ value. The evenness of the obtained piles was very poor and it was possible to see the inner structure of the obtained suede fabric through the piles. Moreover, the appearance of the piles surface was very inferior since there existed many piles whose ends were entangling each other.

EXAMPLE 8

At first, a woven fabric whose structure was velveteen as shown in FIG. 18 was prepared as the weft yarn using a single ply yarn composed of composite filaments consisting of polystyrene as the sea component and polyethylene terephthalate as the island component wherein the mean thickness in denier of island filaments was 0.10 and the degree of variation of thickness of island filaments was 33%, and a polyester filaments yarn was used as the warp yarn. After the woven fabric was treated for thermal relaxation and for extraction of the sea component, an anionic anti-static agent was added. It was then treated by tentering at 160° C. with an extension of 3% in both directions. Thereafter, a raising treatment was carried out 4 times using a raising machine and again the raising treatment was repeated 2 times in the reverse direction. The fabric was dyed a dark color in a rapid dyeing machine and blended with 3% of vinyl acetate resin, 0.5% of a softening agent and 1% of an anti-static agent. At last, after raising the fabric one more time and brushing it, passing the fabric through a paper calender, it was brushed one time from the direction reverse to that of the direction of the piles and again brushed two times into said direction. Finally, the suede fabric was set at 160° C.

The suede woven fabric obtained displayed 250/cm$^2$ for A ($n=10$, $m=6$ $a_1=a_4=o$, $a_2=a_3=a_5-a_6=2$ and $\Sigma a_i=8$), 1.5 mm in its mean length of piles and 4.1 for $G_5/G_{0.5}$.

The obtained fabric had a nice appearance and a touch similar to a suede of deer-skin and had a superior writing effect. Moreover, it had a nice draping property since its thickness was much smaller than that of natural leather (the thickness of the present example was 0.6 mm).

What is claimed as new and intended to be secured by Letters Patent is:

1. A suede woven fabric having a pile surface produced by a pile raising operation comprising a warp yarn selected from the group consisting of polyester textured yarn, polyester filament yarn and polyester spun yarn, and a weft yarn of a composite filament yarn of substantially randomly distributed super fine polyester island filaments of differing thickness whose mean thicknesses in denier are within the range from 0.05 to 0.50 and whose degree of variation of thickness is 15 to 60% from the mean; wherein a portion of said island filaments on at least one surface of the fabric is raised to form piles of individual island monofilaments whose mean lengths are from 0.5 to 4.0 mm, wherein the number of floating points on said weft yarn, whose number of floats is within the range of 3 to 11, is 100 to 500/cm$^2$ of woven fabric; and wherein the relation between the shear stiffness $G_{0.5}$ at a shear angle of 0.5° and the stiffness $G_5$ at a shear angle of 5°, represented by $G_5/G_{0.5}$, is 1.5 to 15.

2. The suede woven fabric of claim 1, wherein the number of islands ih the composite filament is within the range from 5 to 100.

3. The suede woven fabric of claim 2, wherein the number of islands in the composite filament is within the range from 10 to 50.

4. The suede woven fabric of claim 1, wherein about 5 to 40% of the total number of island filaments used as the weft yarn are cut at every floating point to raise them as piles of individual island monofilaments.

5. The suede woven fabric of claim 4, wherein about 5 to 15% of the total number of island filaments used as the weft yarn are cut at every floating point to raise them as piles of individual island monofilaments.

6. The suede woven fabric of claim 1, wherein the degree of variation of the thickness of the island filaments is 20 to 40%.

7. The suede woven fabric of claim 1, wherein the mean thickness in denier of the island filaments is within the range from 0.10 to 0.18.

8. The suede woven fabric of claim 7, where the number of islands in the composite filament is within the range 10 to 50, where the degree of variation of thickness of the island filaments is 20 to 40%, and where about 5 to 40% of the total number of island filaments used as the weft yarn are cut at every floating point to raise them as piles of individual island monofilaments.

9. The suede woven fabric of claim 1, wherein the warp yarn is conposed of polyester textured yarn.

10. A process of manufacturing a suede woven fabric which comprises:

(1) preparing a woven fabric yarn of a polyester textured yarn, polyester filaments yarn or a polyester spun yarn as a warp yarn, and of a single ply yarn blended with two kinds of multiisland randomly distributed composite filaments as a composite filament weft yarn;

wherein each composite filament of the weft yarn is previously prepared using a polyester as the island component and another polymer as the sea component, which polymer has a different solubility from that of the island component of the polyester; randomly distributing the polyester islands in the sea component, which islands extend substantially along the length of the composite filament and have a mean thickness in denier of 0.05 to 0.50 and a degree of variation of thickness of 15 to 60%, and blending the composite filaments so as to obtain said single ply yarn for the weft yarn having 95 to 40 weight % of its islands composed of filaments having a low shrinkability in boiling water and the remaining 5 to 60 weight % composed of filaments having a high shrinkability, its degree of shrinkage in boiling water being at least 3% higher than that of the former, (2) removing the sea component of the filaments, (3) heat-setting the woven fabric to relax it, and (4) raising a portion of the island filaments in the weft yarn on at least one surface of the woven fabric to form piles of individual island monofilaments having mean lengths of 0.5 to 4.0 mm.

11. The process of claim 10, wherein the piles of individual island monofilament are formed by cutting about 5 to 40% of the total number of island filaments in the weft yarn.

12. The process of claim 11, wherein the piles of the individual island monofilaments are formed by cutting about 5 to 15% of the weft yarn.

13. The process of claim 10, wherein 20 to 50 weight % of the composite filaments having a high shrinkability are blended with 80 to 50% of composite filaments having a low shrinkability to form the weft yarn.

14. The process of claim 10, wherein the mean thickness in denier of the islands in the sea component of the composite filament is within the range from 0.10 to 0.18.

15. The process of claim 14, wherein the variation of thickness of the island filaments is 20 to 40%.

16. The process of claim 15, wherein a polyester textured yarn is used for the warp yarn.

17. The process of claim 15, wherein 20 to 50 weight % of the composite filaments having a high shrinkability are blended with 80 to 50% of composite filaments having a low shrinkability to form the weft yarn, wherein the number of islands in each composite filament is within the range 10 to 50 and wherein the piles of the individual island monofilaments are formed by cutting about 5 to 40% of the weft yarn.

18. The process of claim 10, wherein the composite filaments are obtained using a melt spinning apparatus comprising a plat A having at least two polymer outlets of concentric ring structure; a plate B to be attached just under the plate A, having a concave slit to receive a molten polymer from the plate A, and provided with many polymer inlet holes at the center of said concave slit, wherein the holes are distributed along a circle whose direction coincides with the circumferential direction of said polymer outlets of the plate A; a plate C to be attached under the plate B, having channels whose polymer inlets are situated at position corresponding to the polymer outlet holes of the plate B and whose polymer outlets are situated along a line substantially parallel to the circumferential direction of the corresponding inlets; a plate D, to be attached under the plate C, having concentric slits of ring structure whereby are connected a set of a plural number of outlets of the plate C with a specified slit chosen from said slits on page D, wherein said slits have a definite depth, not penetrating the plate and have many holes therein whereby the polymer is directed into the next plate; and another plate B attached under the plate D.

* * * * *